US005878438A

United States Patent [19]

Ragsdale

[11] Patent Number: 5,878,438

[45] Date of Patent: Mar. 9, 1999

[54] INSULATED MITT WITH UTENSIL

[76] Inventor: Daniel S. Ragsdale, 5151 Annette St., Indianapolis, Ind. 46208

[21] Appl. No.: 7,318

[22] Filed: Jan. 15, 1998

[51] Int. Cl.[6] ..... A41D 13/10; A41D 19/01

[52] U.S. Cl. ..... 2/158; 2/160; 2/161.6; 2/17

[58] Field of Search ..... 2/158, 159, 160, 2/17, 20, 161.6, 161.1, 161.5, 16; 224/218, 219, 220, 230, 232, 234

[56] References Cited

U.S. PATENT DOCUMENTS

| | | | |
|---|---|---|---|
| 136,640 | 3/1873 | Bond | 2/21 |
| 617,755 | 1/1899 | Martin | 2/161.6 |
| 626,969 | 6/1899 | Counselman | 2/17 |
| 2,294,997 | 9/1942 | Merrion | 2/160 |
| 3,116,502 | 1/1964 | Gerber | 2/158 |
| 4,089,379 | 5/1978 | Corwnover | 2/17 |
| 4,447,912 | 5/1984 | Morrow | 2/159 |
| 4,583,320 | 4/1986 | Batt | 2/160 |
| 4,683,592 | 8/1987 | Strongwater | 2/160 |
| 5,276,922 | 1/1994 | Floyd, Jr. | 2/160 |
| 5,471,681 | 12/1995 | Ferrini | 2/161.6 |
| 5,644,796 | 7/1997 | Laughlin | 2/160 |

*Primary Examiner*—Amy Vanatta

[57] ABSTRACT

A new Insulated Mitt With Utensil for protecting the hands of a cook while preparing foods. The inventive device includes a palm piece and a back piece joined together to form a mitten, and an elongated rigid utensil removably and interchangeably fastened to each the palm piece and the back piece with an end of the utensil extending beyond the mitten whereby the mitten can be worn interchangeably on the left hand and the right hand of the wearer and the utensil can be effectively grasped and manipulated to perform various cooking tasks.

18 Claims, 2 Drawing Sheets

INSULATED MITT WITH UTENSIL

BACKGROUND OF THE INVENTION

1. Field of the Invention

The present invention relates to combined glove and tool devices and more particularly pertains to a new Insulated Mitt With Utensil for protecting the hands of a cook while preparing foods.

2. Description of the Prior Art

The use of combined glove and tool devices is known in the prior art. More specifically, combined glove and tool devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art combined glove and tool devices include U.S. Pat. No. 4,538,320; U.S. Pat. No. 5,088,121; U.S. Pat. No. D306,366; U.S. Pat. No. 4,203,495; U.S. Pat. No. 5,276,922; and U.S. Pat. No. 4,149,296.

While these devices fulfill their respective, particular objectives and requirements, the aforementioned patents do not disclose a new Insulated Mitt With Utensil. The inventive device includes a palm piece and a back piece joined together to form a mitten, and an elongated rigid utensil removably and interchangeably fastened to each the palm piece and the back piece with an end of the utensil extending beyond the mitten whereby the mitten can be worn interchangeably on the left hand and the right hand of the wearer and the utensil can be effectively grasped and manipulated to perform various cooking tasks.

In these respects, the Insulated Mitt With Utensil according to the present invention substantially departs from the conventional concepts and designs of the prior art, and in so doing provides an apparatus primarily developed for the purpose of protecting the hands of a cook while preparing foods.

SUMMARY OF THE INVENTION

In view of the foregoing disadvantages inherent in the known types of combined glove and tool devices now present in the prior art, the present invention provides a new Insulated Mitt With Utensil construction wherein the same can be utilized for protecting the hands of a cook while preparing foods.

The general purpose of the present invention, which will be described subsequently in greater detail, is to provide a new Insulated Mitt With Utensil apparatus and method which has many of the advantages of the combined glove and tool devices mentioned heretofore and many novel features that result in a new Insulated Mitt With Utensil which is not anticipated, rendered obvious, suggested, or even implied by any of the prior art combined glove and tool devices, either alone or in any combination thereof.

To attain this, the present invention generally comprises a palm piece and a back piece joined together to form a mitten, and an elongated rigid utensil removably and interchangeably fastened to each the palm piece and the back piece with an end of the utensil extending beyond the mitten whereby the mitten can be worn interchangeably on the left hand and the right hand of the wearer and the utensil can be effectively grasped and manipulated to perform various cooking tasks.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Insulated Mitt With Utensil apparatus and method which has many of the advantages of the combined glove and tool devices mentioned heretofore and many novel features that result in a new Insulated Mitt With Utensil which is not anticipated, rendered obvious, suggested, or even implied by any of the prior art combined glove and tool devices, either alone or in any combination thereof.

It is another object of the present invention to provide a new Insulated Mitt With Utensil which may be easily and efficiently manufactured and marketed.

It is a further object of the present invention to provide a new Insulated Mitt With Utensil which is of a durable and reliable construction.

An even further object of the present invention is to provide a new Insulated Mitt With Utensil which is susceptible of a low cost of manufacture with regard to both materials and labor, and which accordingly is then susceptible of low prices of sale to the consuming public, thereby making such Insulated Mitt With Utensil economically available to the buying public.

Still yet another object of the present invention is to provide a new Insulated Mitt With Utensil which provides in the apparatuses and methods of the prior art some of the advantages thereof, while simultaneously overcoming some of the disadvantages normally associated therewith.

Still another object of the present invention is to provide a new Insulated Mitt With Utensil for protecting the hands of a cook while preparing foods.

Yet another object of the present invention is to provide a new Insulated Mitt With Utensil which includes a palm piece and a back piece joined together to form a mitten, and an elongated rigid utensil removably and interchangeably fastened to each the palm piece and the back piece with an end of the utensil extending beyond the mitten whereby the mitten can be worn interchangeably on the left hand and the right hand of the wearer and the utensil can be effectively grasped and manipulated to perform various cooking tasks.

Still yet another object of the present invention is to provide a new Insulated Mitt With Utensil that would allow a cook to safely manipulate dishes and pans. More specifically, the present invention would allow a cook to safely separate and remove an insert pan containing food from a steam table pan.

Even still another object of the present invention is to provide a new Insulated Mitt With Utensil that would prevent a cook from burning his or her fingers and would also increase safety awareness in a kitchen.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
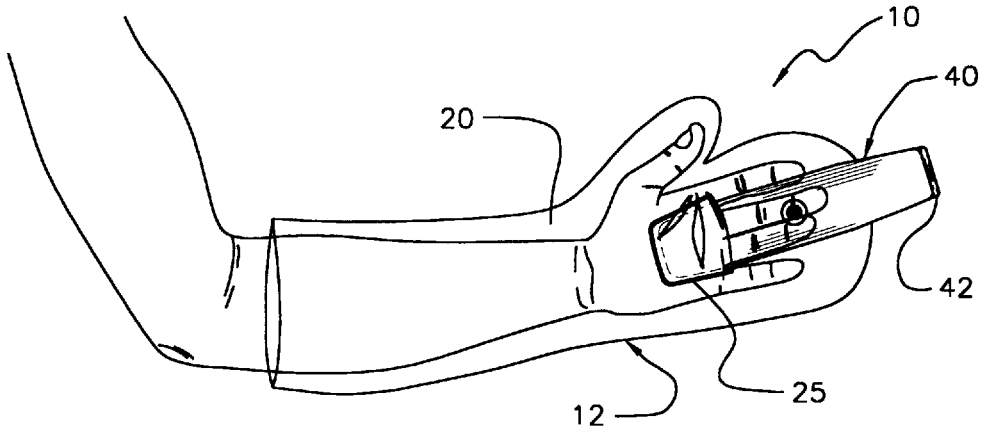
FIG. 1 is an illustration of the present invention worn on the left hand of a wearer.
Figure 2:
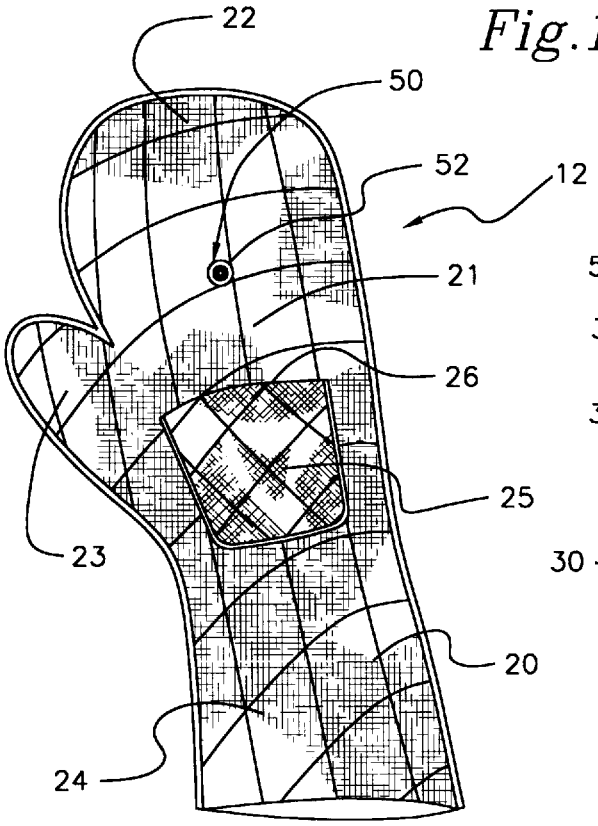
FIG. 2 is a palm side view of the mitten of the present invention.
Figure 3:
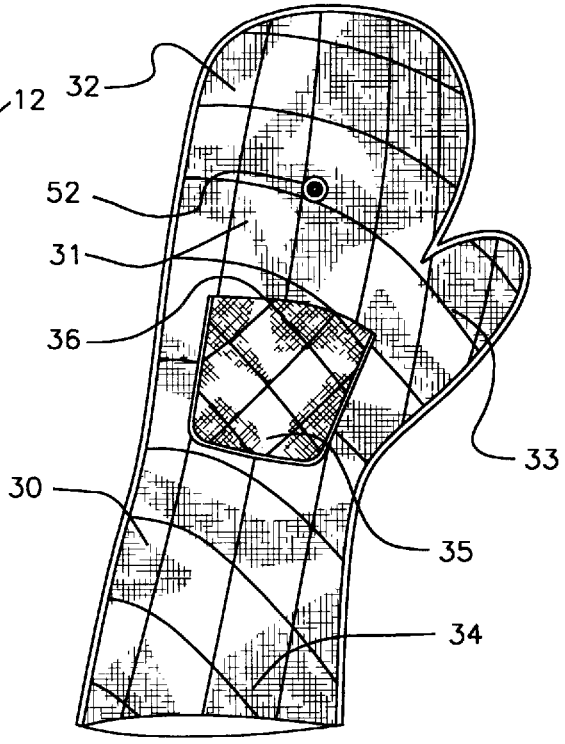
FIG. 3 is a back side view of the mitten of the present invention.
Figure 4:
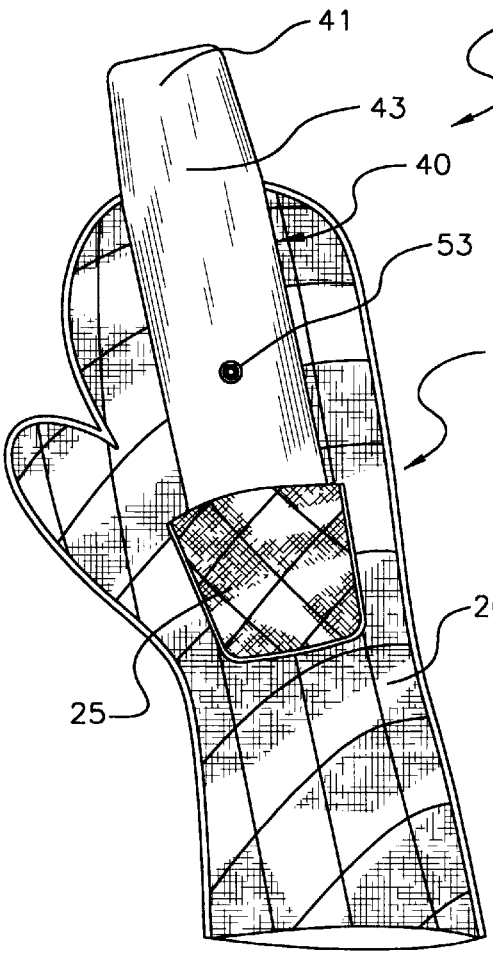
FIG. 4 is a palm side view of the mitten with the utensil fastened thereto.
Figure 5:
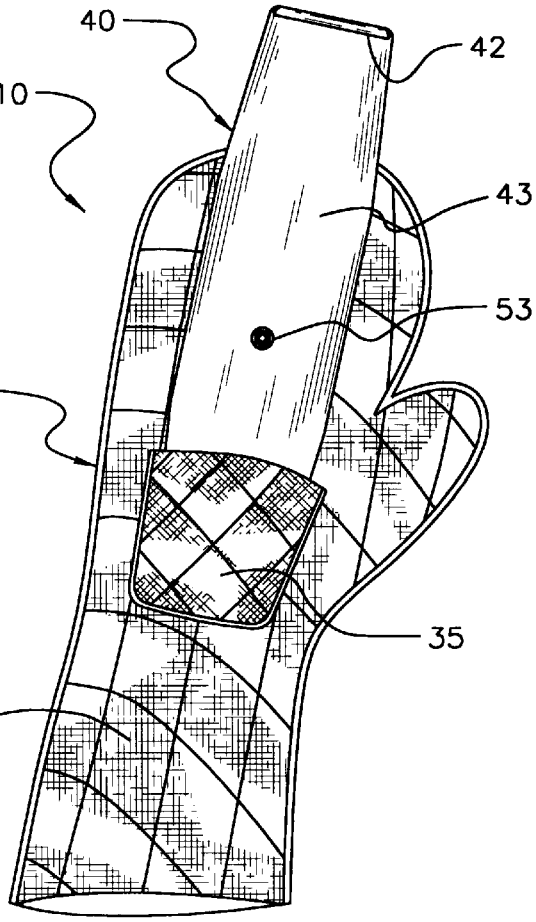
FIG. 5 is a back side view of the mitten with the utensil fastened thereto.
Figure 6:
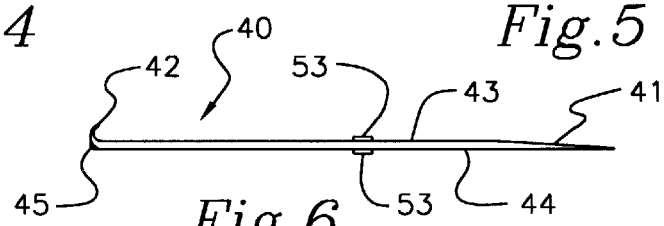
FIG. 6 is a side view of the utensil of the present invention.
Figure 7:
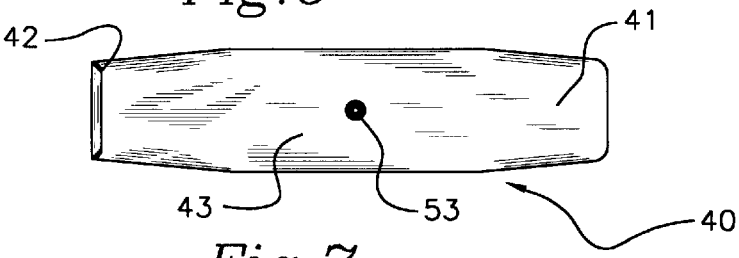
FIG. 7 is a top side view of the utensil of the present invention.

With reference now to the drawings, and in particular to FIGS. 1 through 7 thereof, a new Insulated Mitt With Utensil embodying the principles and concepts of the present invention and generally designated by the reference numeral 10 will be described.

As best illustrated in FIGS. 1 through 7, the Insulated Mitt With Utensil 10 comprises a palm piece 20 and a back piece 30 joined together to form a mitten 12, and an elongated rigid utensil 40 removably and interchangeably fastened to each the palm piece 20 and the back piece 30 with an end of the utensil 40 extending beyond the mitten 12 whereby the mitten 12 can be worn interchangeably on the left hand and the right hand of the wearer and the utensil 40 can be effectively grasped and manipulated to perform various cooking tasks.

It is important to note that the figures and the description herein are directed to a single mitten 12 wherein the mitten 12 may be worn interchangeably on the left hand and the right hand of the wearer. As such, the palm piece 20 and the back piece 30 are identical. Accordingly, the terms palm piece and back piece as used herein are used only to describe the mitten when worn on the left hand of the wearer wherein the palm piece 20 covers the palm of the wearer's left hand and the back piece 30 covers the back of the wearer's left hand. However, it is to be understood that when the wearer wears the mitten 12 on his or her right hand, the palm piece 20 covers the back of the wearer's right hand and the back piece 30 covers the palm of the wearer's right hand.

As best illustrated in FIGS. 1 through 5, the palm piece 20 and the back piece 30 each include a mid-portion 21 and 31, a finger portion 22 and 32 extending from one end of the mid-portion 21 and 31 for covering the fingers of the wearer, and a thumb portion 23 and 33 diverging from a side of the mid-portion 21 and 31 for covering the thumb of the wearer. Accordingly, the palm piece 20 and the back piece 30 are superimposed upon each other and are cooperatively joined along mating perimetrical edges thereof to form the mitten 12. The palm piece 20 and the back piece 30 are each formed of a heat-insulative material.

In a preferred embodiment, the palm piece 20 and the back piece 30 each include a gauntlet portion 24 and 34 extending from an opposite end of the mid-portion 21 and 31 for covering the forearm of the wearer. Ideally, the gauntlet portion 24 and 34 extends to the upper forearm of the wearer so that the hand and the forearm of the wearer are completely covered and protected.

As best illustrated in FIGS. 2 through 5, a pouch 25 and 35 is provided on the mid-portion 21 and 31 of each the palm piece 20 and the back piece 30 whereby the pouch 25 and 35 is positioned in the palm of the hand of the wearer and on the backside of the hand of the wearer. The pouch 25 and 35 is sized for receiving one end of the utensil 40. As such, the pouch 25 and 35 is generally rectangular in shape and is joined to the mid-portion 21 and 31 along three edges. Accordingly, the pouch 25 and 35 has an opening 26 and 36 along one edge wherein the opening 26 and 36 is directed toward the finger portion 22 and 32 of the respective palm piece 20 and back piece 30.

As best illustrated in FIGS. 4 through 7, the elongated rigid utensil 40 has a first working end 41 and a second working end 42, and has a top side 43 and a bottom side 44. In a preferred embodiment, the first working end 41 is beveled and the second working end 42 is curled upward and backward above the top side 43 and toward the first working end 41. In an optional embodiment, a transverse bead 45 is provided on the bottom side 44 of the utensil 40 adjacent the second working end 42. Preferably, the transverse bead 45 extends the entire width of the utensil 40.

A releasable fastener 50 is provided for removably and interchangeably fastening the utensil 40 to each the palm piece 20 and the back piece 30 of the mitten 12. In a preferred embodiment, the releasable fastener 50 is a snap 51 including a post piece 52 and a socket piece 53 releasably fitting over the post piece 52. In an illustrative embodiment, the post piece 52 of the snap 51 is provided on the mid-portion 21 and 31 of each the palm piece 20 and the back piece 30 of the mitten 12 and the socket piece 53 of the snap 51 is provided on each the top side 43 and the bottom side 44 of the utensil 40. The socket piece 53 is provided intermediate the first working end 41 and the second working end 42 of the utensil 40 at a midpoint thereof.

Accordingly, the top side 43 and the bottom side 44 of the utensil 40 are each interchangeably fastenable to the palm piece 20 and the back piece 30 of the mitten 12 wherein the first working end 41 and the second working end 42 are each alternately extendable beyond the finger portion 22 and 32 of each the palm piece 20 and the back piece 30 of the mitten 12.

In use, the utensil 40 is fastened to the palm piece 20 of the mitten 12 with the snap 51. The utensil 40 is oriented such that the first working end 41 or the second working end 42, depending on which end the wearer wishes to use, extends beyond the mitten 12. Accordingly, when the wearer wishes to use the first working end 41, the second working end 42 is fitted within the pouch 25 and when the wearer wishes to use the second working end 42, the first working end 41 is fitted within the pouch 25. Thereafter, the wearer inserts his or her left or right hand into the mitten 12.

As such, the utensil 40 can be effectively grasped and manipulated to perform various cooking tasks. More specifically, the first working end 41 of the utensil 40 may be used for arranging and separating hot pans and dishes, such as those sitting in a hot oven. Furthermore, the second working end 42 of the utensil 40 may be used for separating an insert pan from a steam table pan wherein the second working end 42 of the utensil 40 may be wedged between the insert pan and the steam table pan whereby the insert pan may be lifted out. While separating the insert pan and the steam table pan, the transverse bead 45 is positioned on the lip of the steam table pan whereby the transverse bead 45 helps to create a gap between the pans sufficient for the wearer to fit the fingers of his or her other hand into.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An insulated mitt with utensil, comprising:

a palm piece and a back piece joined together to form a mitten, said palm piece and said back piece each including a mid-portion, a finger portion extending from an end of said mid-portion for covering the fingers of said wearer, and a thumb portion diverging from a side of said mid-portion for covering the thumb of said wearer;

an elongated rigid utensil removably and interchangeably fastened to said palm piece and said back piece with an end of said utensil extending beyond said mitten, whereby a wearer of said mitten can effectively grasp an opposite end of said utensil and manipulate said utensil; and a pouch provided on said mid-portion of each of said palm piece and said back piece, said pouch positioned in the palm of the hand of said wearer and on the backside of the hand of said wearer, said pouch having an opening directed toward said finger portion of said palm piece and said back piece, said pouch sized for receiving one end of said utensil.

2. The insulated mitt with utensil of claim 1, wherein said palm piece and said back piece are each formed of a heat-insulative material.

3. The insulated mitt with utensil of claim 1, wherein said palm piece and said back piece each include a gauntlet portion extending from an opposite end of said mid-portion for covering the forearm of said wearer.

4. The insulated mitt with utensil of claim 3, wherein said gauntlet portion extends to the upper forearm of said wearer, whereby the hand and the forearm of said wearer are completely covered and protected.

5. The insulated mitt with utensil of claim 1, wherein said elongated rigid utensil has a first working end and a second working end, and has a top side and a bottom side, said first working end being beveled and said second working end being curled back a toward said first working end.

6. The insulated mitt with utensil of claim 5, further comprising:

a transverse bead provided on said bottom side of said utensil adjacent said second working end.

7. The insulated mitt with utensil of claim 1, further comprising:

a fastening means for removably and interchangeably fastening said utensil to each of said palm piece and said back piece.

8. An insulated mitt with utensil, comprising:

a palm piece and a back piece each including a mid-portion, a finger portion extending from an end of said mid-portion, and a thumb portion diverging from a side of said mid-portion, said palm piece and said back piece superimposed upon each other and cooperatively joined together to form a mitten;

a pouch provided on said mid-portion of each of said palm piece and said back piece, said pouch having an opening directed toward said finger portion of said palm piece and said back piece;

an elongated rigid utensil having a first working end and a second working end, and having a top side and a bottom side, said first working end being beveled and said second working end being curled backward toward said first working end, one of said first working end and said second working end fitting within said pouch provided on one of said palm piece and said back piece; and a fastening means for removably and interchangeably fastening each of said top side and said bottom side of said utensil to each of said palm piece and said back piece of said mitten, whereby one of said first working end and said second working end of said utensil extends beyond said mitten.

9. The insulated mitt with utensil of claim 8, wherein said palm piece and said back piece are each formed of a heat-insulative material.

10. The insulated mitt with utensil of claim 8, wherein said palm piece and said back piece each include a gauntlet portion extending from an opposite end of said mid-portion.

11. The insulated mitt with utensil of claim 8, further comprising:

a transverse bead provided on said bottom side of said utensil adjacent said second working end.

12. The insulated mitt with utensil of claim 8, wherein said fastening means comprises:

a snap including a post piece and a socket piece releasably fitting over said post piece, said post piece being provided on said mid-portion of each of said palm piece and said back piece of said mitten and said socket piece being provided on each of said top side and said bottom side of said utensil, wherein said top side and said bottom side of said utensil are each interchangeably fastenable to each of said palm piece and said back piece of said mitten, whereby said first working end and said second working end of said utensil are each alternately extendable beyond said finger portion of each of said palm piece and said back piece of said mitten.

13. An insulated mitt with utensil, comprising:

a first piece and a second piece each including a mid-portion, a finger portion extending from an end of said mid-portion for covering the fingers of a wearer, and a thumb portion diverging from a side of said mid-portion for covering the thumb of said wearer, said first piece superimposed on and cooperatively joined to said second piece along mating edges to form a mitten, whereby said mitten can be worn interchangeably on the left hand and the right hand of said wearer;

a first pouch provided on said mid-portion of said first piece, said first pouch having an opening directed toward said finger portion of said first piece;

a second pouch provided on said mid-portion of said second piece, said second pouch having an opening directed toward said finger portion of said second piece;

an elongated rigid utensil having a first working end and a second working end, and having a top side and a bottom side, said first working end being beveled and said second working end being curled backward toward said first working end, one of said first working end and said second working end being fitted within one of said first pouch and said second pouch, whereby said utensil can be effectively grasped and manipulated; and a fastening means for removably and interchangeably fastening each of said top side and said bottom side of said utensil to each of said first piece and said second piece of said mitten, whereby one of said first working end and said second working end of said utensil extends beyond said mitten.

14. The insulated mitt with utensil of claim 13, wherein said first piece and said second piece are each formed of a heat-insulative material.

15. The insulated mitt with utensil of claim 13, wherein said first piece and said second piece each include a gauntlet portion extending from an opposite end of said mid-portion for covering the forearm of said wearer.

16. The insulated mitt with utensil of claim 13, further comprising:

a transverse bead provided on said bottom side of said utensil adjacent said second working end.

17. The insulated mitt with utensil of claim 13, wherein said fastening means comprises:

a first snap post-piece provided on said mid-portion of said first piece of said mitten, a second snap post-piece provided on said mid-portion of said second piece of said mitten, a first snap socket-piece provided on said top side of said utensil, and a second snap socket-piece provided on said bottom side of said utensil, each of said first snap socket-piece and said second snap socket-piece releasably and interchangeably fitting over each of said first snap post-piece and said second snap post-piece, wherein said top side and said bottom side of said utensil are each interchangeably fastenable to each of said first piece and said second piece of said mitten, whereby said first working end and said second working end of said utensil are each alternately extendable beyond said finger portion of each of said first piece and said second piece of said mitten.

18. An insulated mitt with utensil, comprising:

a palm piece and a back piece joined together to form a mitten;

an elongated rigid utensil removably and interchangeably fastened to said palm piece and said back piece with an end of said utensil extending beyond said mitten, whereby a wearer of said mitten can effectively grasp an opposite end of said utensil and manipulate said utensil; and said elongated rigid utensil having a first working end and a second working end, and has a top side and a bottom side, said first working end being beveled and said second working end being curled back toward said first working end.

* * * * *